US006497494B1

(12) United States Patent
Lin

(10) Patent No.: US 6,497,494 B1
(45) Date of Patent: Dec. 24, 2002

(54) LIGHTING DEVICE FOR A SOCKET WRENCH

(76) Inventor: Chang-Ming Lin, No. 331, Chang Chun St., Chiu Te Village, Wu Jih Hsiang, Taichung County (TW)

( * ) Notice: Subject to any disclaimer, the term of this patent is extended or adjusted under 35 U.S.C. 154(b) by 90 days.

(21) Appl. No.: 09/659,863

(22) Filed: Sep. 12, 2000

(51) Int. Cl.[7] ..... F21W 111/10; F21L 4/04

(52) U.S. Cl. ..... 362/119; 362/185; 362/197; 362/199

(58) Field of Search ..... 362/109, 119, 362/120, 184, 185, 186, 197, 199

(56) References Cited

U.S. PATENT DOCUMENTS 4,364,104 A * 12/1982 Holahan et al. ..... 362/109
5,971,560 A * 10/1999 Chen ..... 362/119
6,224,229 B1 * 5/2001 Lin ..... 362/119
6,386,727 B1 * 5/2002 Yeh ..... 362/119

* cited by examiner

*Primary Examiner*—Alan Cariaso
(74) *Attorney, Agent, or Firm*—Harrison & Egbert

(57) ABSTRACT

A socket wrench is provided With a lighting device. The socket wrench has a handle, and a grip body which is provided at one end with a fitting hole and at another end with a plugging hole. The grip body is further provided in the underside of one end thereof with a base and a rotary body which is pivoted with the base and provided with two rotary shafts, with each being fastened to a dial button. The rotary body is provided with two through holes in which two light-emitting elements are disposed such that the two light-emitting elements are connected with two battery sets by two elastic bonding wires. The base is provided in the bottom with a transparent cover to shield the light-emitting elements.

1 Claim, 9 Drawing Sheets

LIGHTING DEVICE FOR A SOCKET WRENCH

BACKGROUND OF THE INVENTION

1. Field of the Invention

The present invention relates generally to a socket wrench, and more particularly to a lighting device of the socket wrench.

2. Description of Related Art

As shown in FIGS. 1 and 2, a prior art socket wrench 10 is provided with a grip body 12 which is in turn provided at one end thereof with a fitting hole 13, and at another end thereof with a plugging hole 14 having outer threads 15 and a press shoulder 16. The grip body 12 is fitted over the handle of the socket wrench 10 through the fitting hole 13. An insulation plug body 17 having two conductive pieces 18, a battery set 19, and a switching element 20 having a protruded shoulder 21, a press button 22 and a connection point spring 23, are received in the plugging hole 14 in conjunction with a cap 24 having a hole 25 and inner threads which are engaged with the outer threads 15 of the plugging hole 14. The grip body 12 is provided in the underside of one end thereof with a receiving slot 30 having the pivoting portions 31 and being in communication with the plugging hole 14. The pivoting portions 31 are provided with a guide slot 32 and a dial member 33 having a shaft rod 34, a light bulb port 35 in which two pins 27 of a light-emitting element 36 are disposed such that the two pins 27 are connected with the dial member 33 by two conductive. pieces 38. Two conductive bodies 39 of the conductive pieces 18 are extended into the receiving slot 30 such that the conductive bodies 39 are in contact with the conductive pieces 38.

The prior art lighting device has drawbacks. In the first place, the pins 37 of the light-emitting element 36, the two conductive pieces 38, and the conductive bodies 39 are vulnerable to moving aside to result in poor contact at the time when the base 40 is impacted on by an external force. Secondly, the light-emitting element 36 is extended out of the dial member 33 and is devoid of a protective shield.

BRIEF SUMMARY OF THE INVENTION

The primary objective of the present invention is to provide a socket wrench with a lighting device which is free of the drawbacks of the prior art lighting device described above.

The features and the advantages of the present invention will be readily understood upon a thoughtful deliberation of the following detailed description of the present invention with reference to the accompanying drawings.

DETAILED DESCRIPTION OF THE INVENTION

Figure 1:
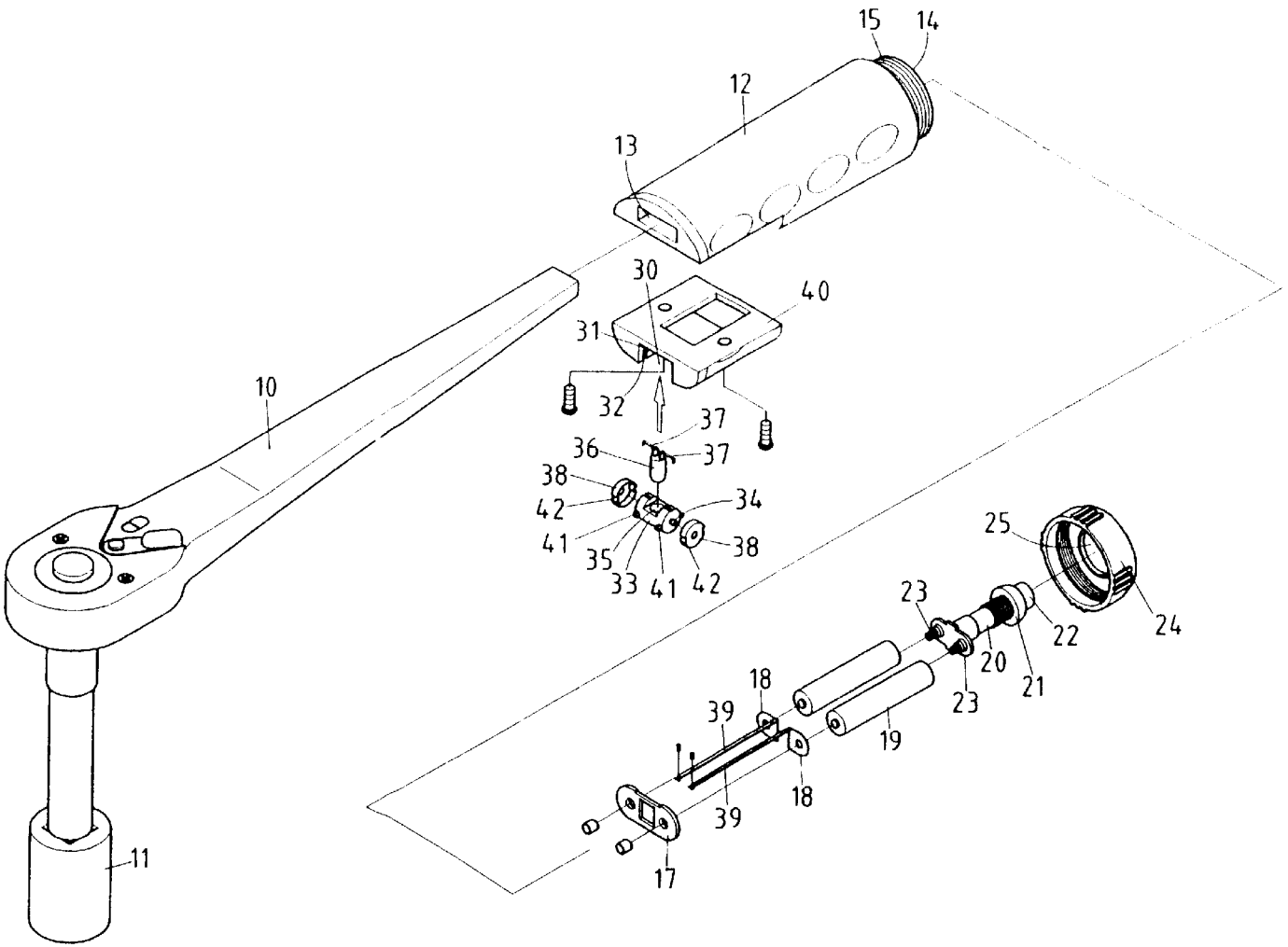
FIG.1 PRIOR ART
FIG. 1 shows an exploded view of the prior art.
Figure 2:
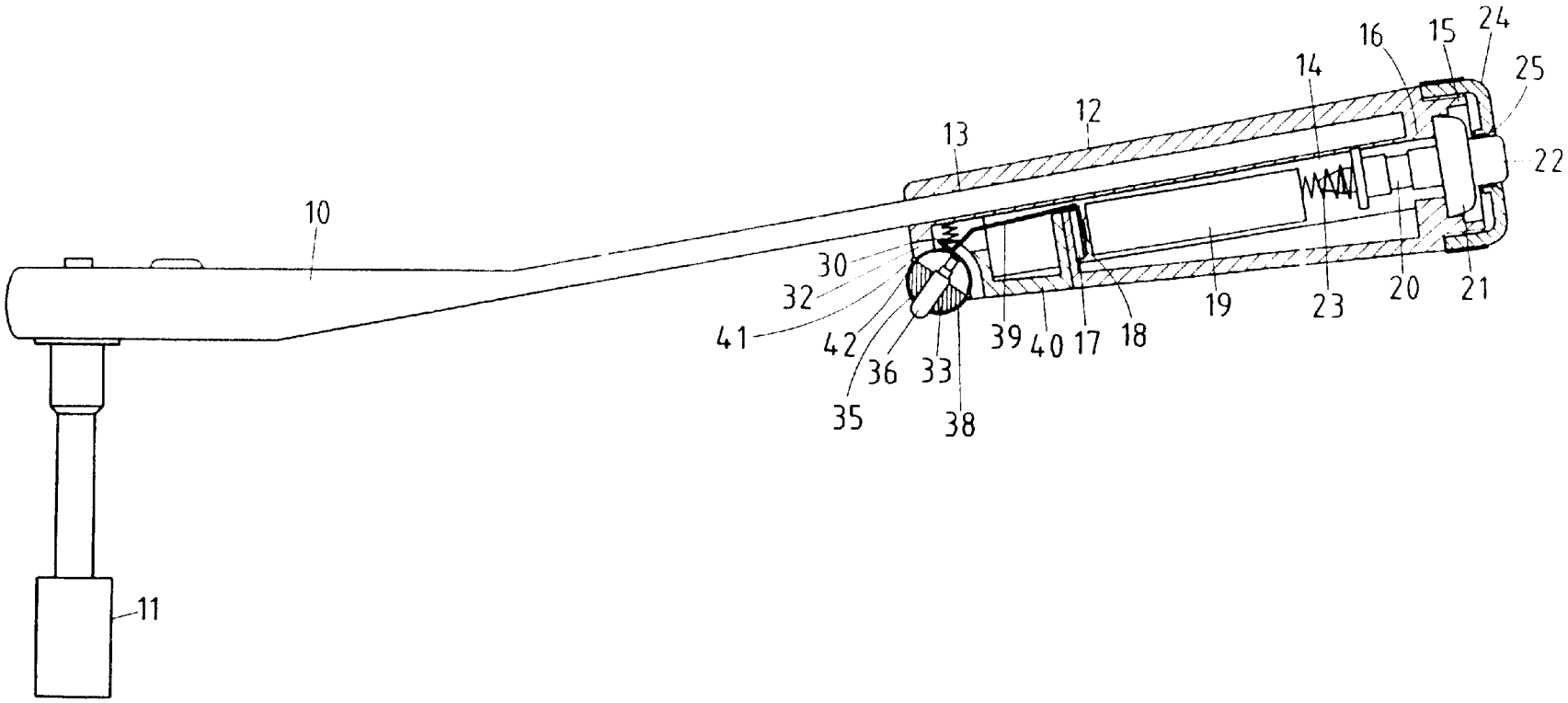
FIG. 2 PRIOR ART
FIG. 2 shows a longitudinal sectional view of the prior art.
Figure 3:
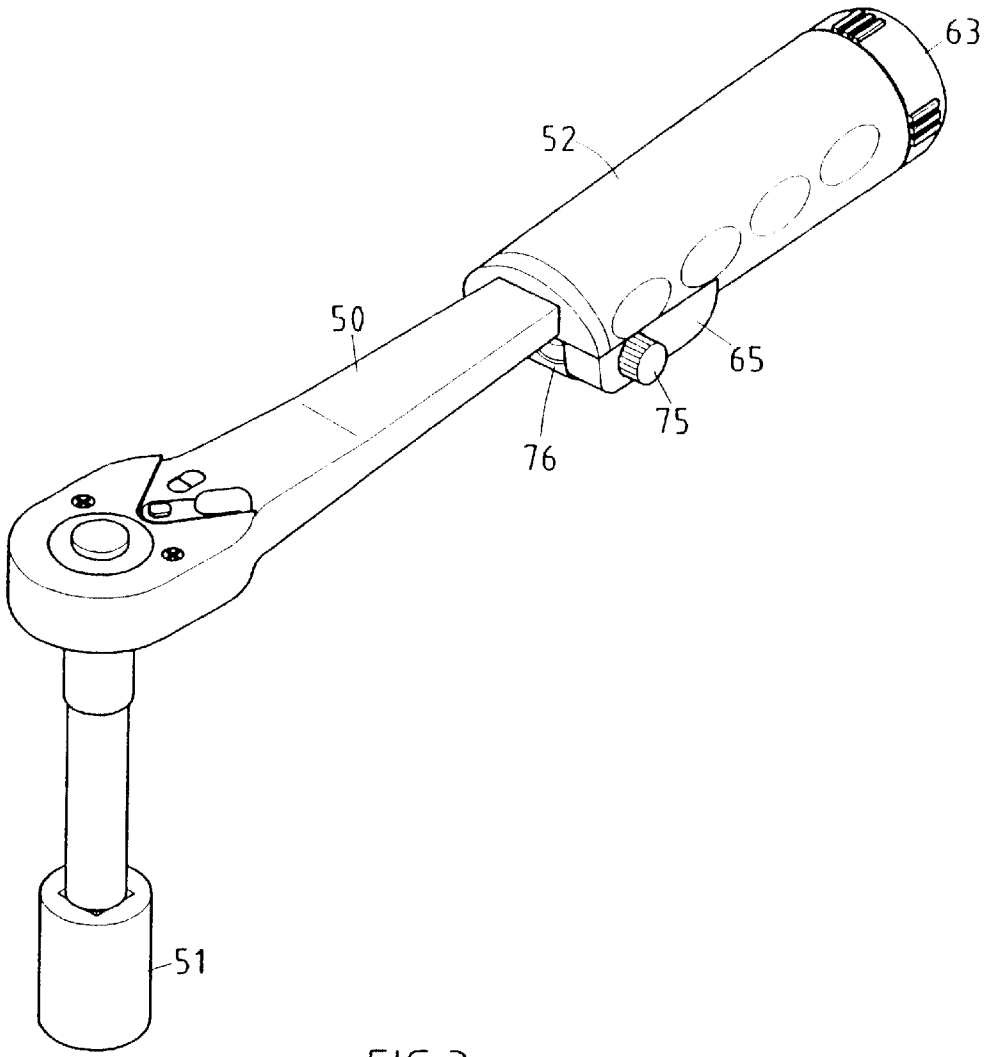
FIG. 3 shows a perspective view of the present invention.
Figure 4:
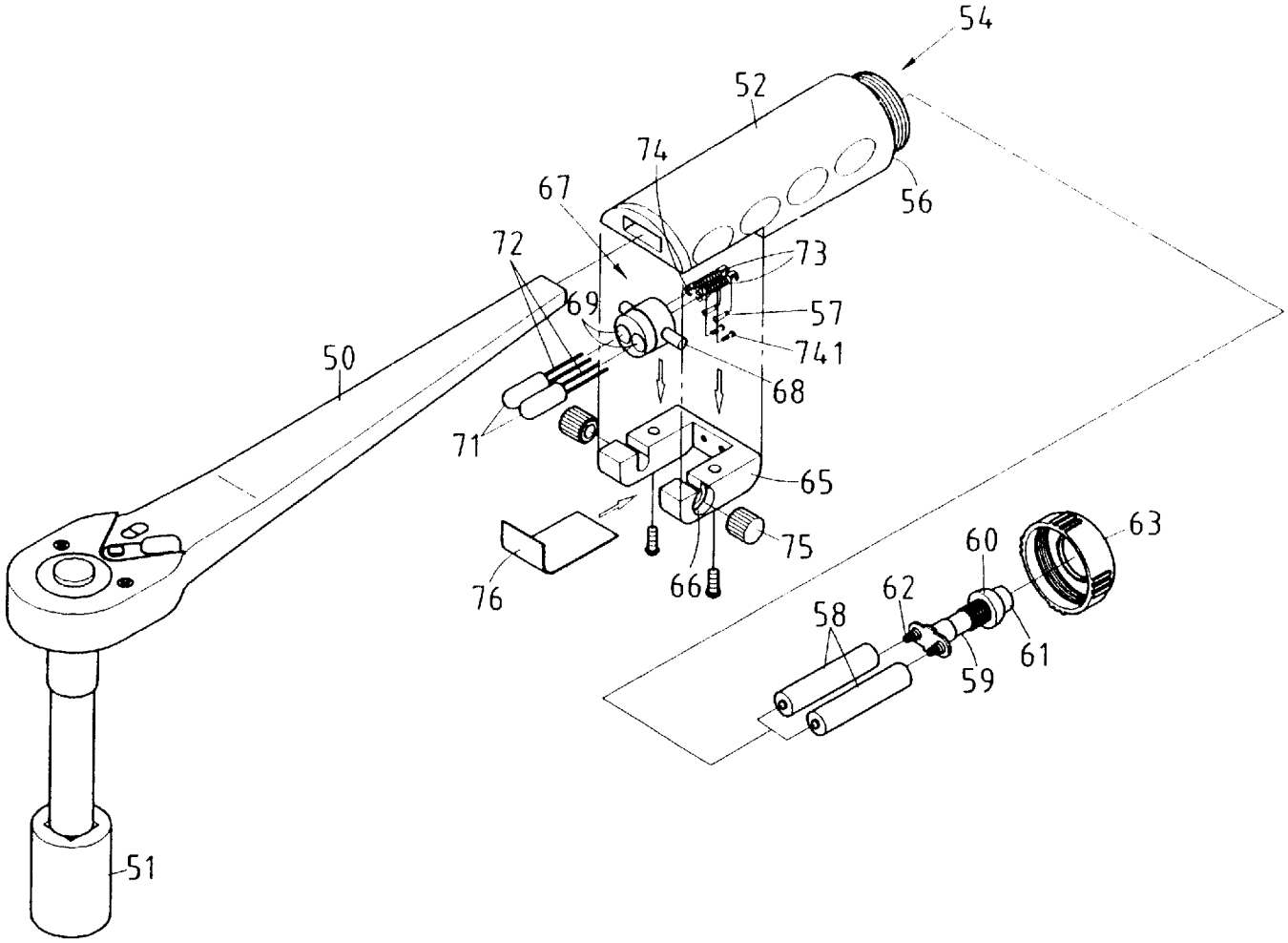
FIG. 4 shows an exploded view of the present invention.
Figure 5:
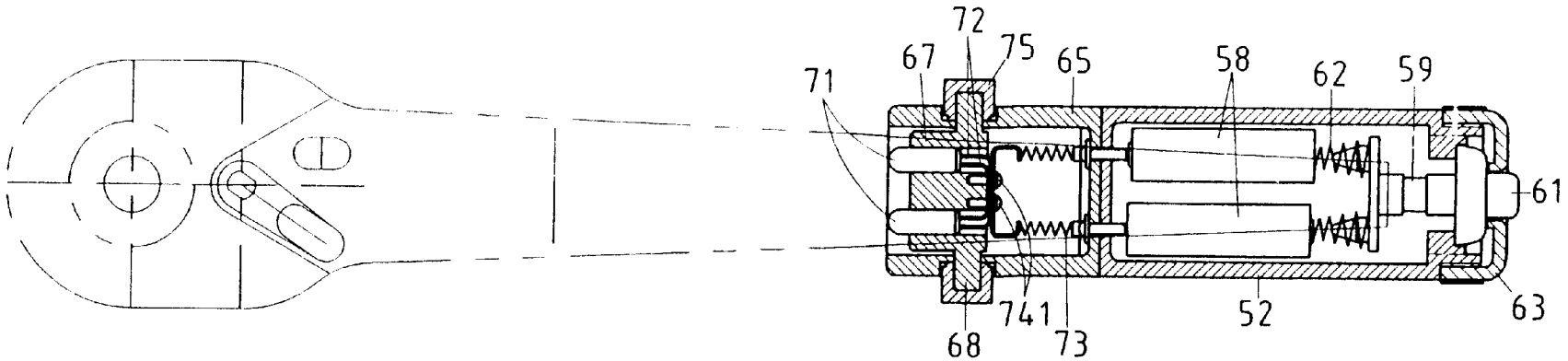
FIG. 5 shows a longitudinal sectional view of the present invention.
Figure 6:
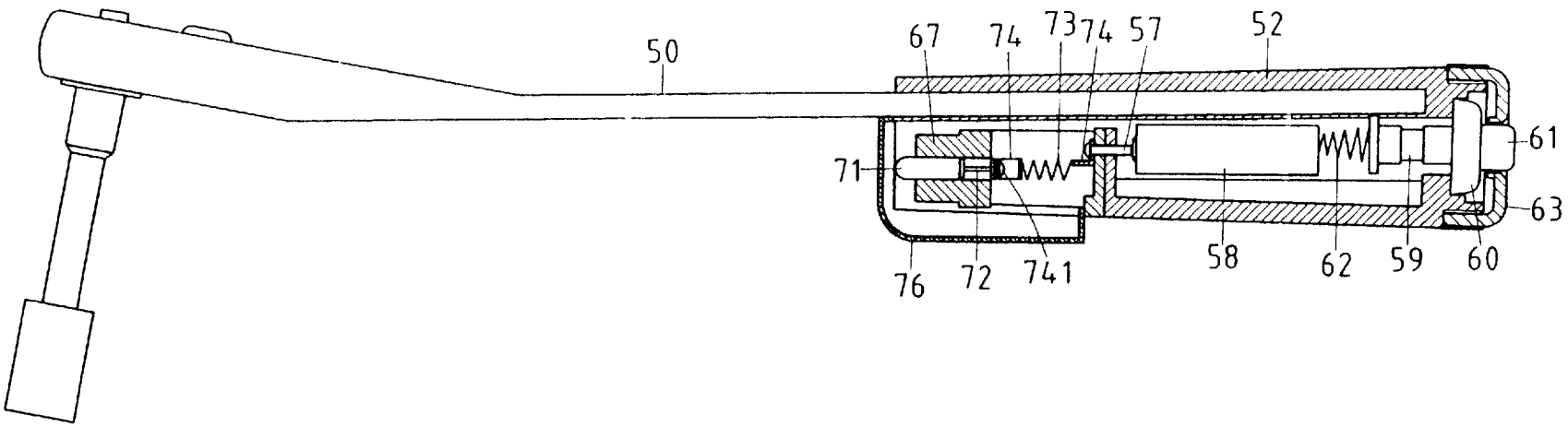
FIG. 6 shows another longitudinal sectional view of the present invention.
Figure 7:
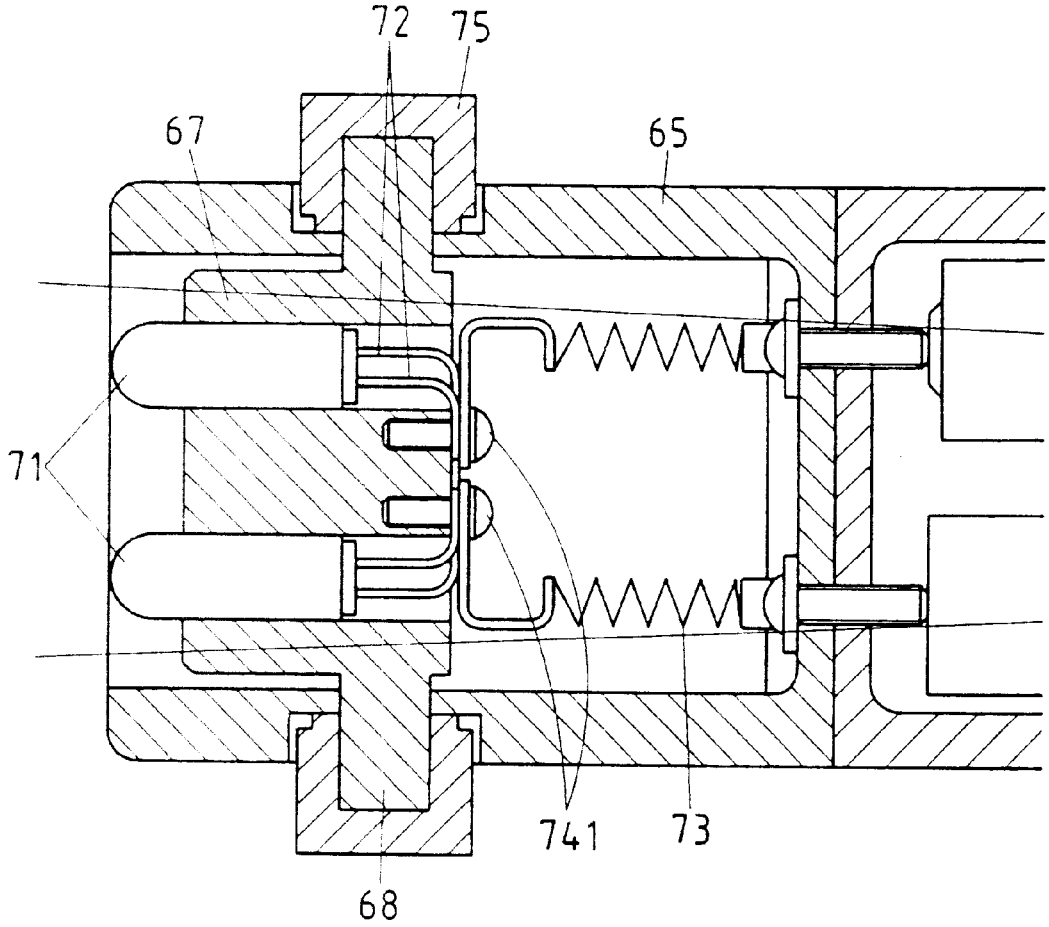
FIG. 7 shows a partial sectional view of the present invention.

As shown in FIGS. 3–7, a socket wrench handle 50 of the present invention is fitted at the free end thereof into a fitting hole, 53 of one end of a grip body 52. The grip body 52 is provided at another end thereof with a plugging hole 54 having a threaded portion 55 and a shoulder 56. The plugging hole 54 is provided therein with two parallel battery sets 58 and a switching element having a protruded shoulder 60, a press button 61 and a connection point spring 62. The plugging hole 54 is provided with a cap 63 having a receiving hole 64. The grip body 52 is provided in the underside of the one end thereof with a base 65 having two pivoting slots 66.

The base 65 is provided with a rotary body 67, two light-emitting elements 71, two elastic bonding wires 73, and a transparent cover 76.

The rotary body 67 has two rotary shafts 68, which are received in the two pivoting slots 66 such that the rotary shafts 68 are fastened to a dial button 75. The rotary body 67 is provided with two through holes 69.

The light-emitting elements 71 are received in the two through holes 69 of the rotary body 67 such that the positive and the negative pins 72 of the light-emitting elements 71 are extended out of the rotary body 67 to join with two screws 741.

The elastic bonding wires 73 are disposed between the rotary body 67 and the battery sets 58 such that the positive and the negative terminals 74 of the bonding wires 73 are connected with the battery sets 58 by a plurality of conductive screws 57, and such that the other positive and negative terminals 74 of the bonding wires 73 are connected with the pins 72 of the light-emitting elements 71 by a plurality of screws 741.

The transparent cover 76 is fastened to the bottom of the base 65 to shield the light-emitting elements 71.

Figure 9:
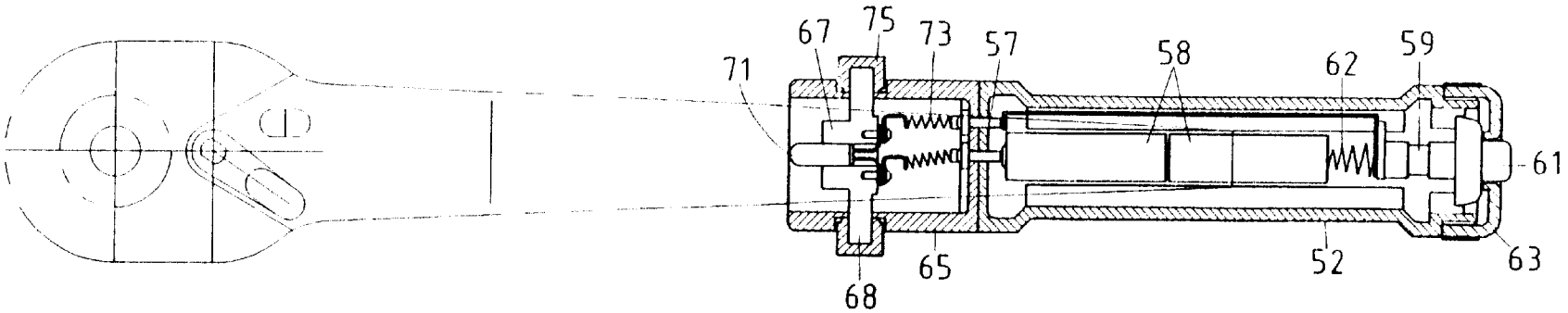
FIG. 9 shows a longitudinal sectional view of another preferred embodiment of the present invention.

The rotary body 67 of the present invention may be provided with only one light-emitting element 71, as shown in FIG. 9.

The battery sets 58 of the present invention may be serially arranged, as shown in FIG. 9.

Figure 8:
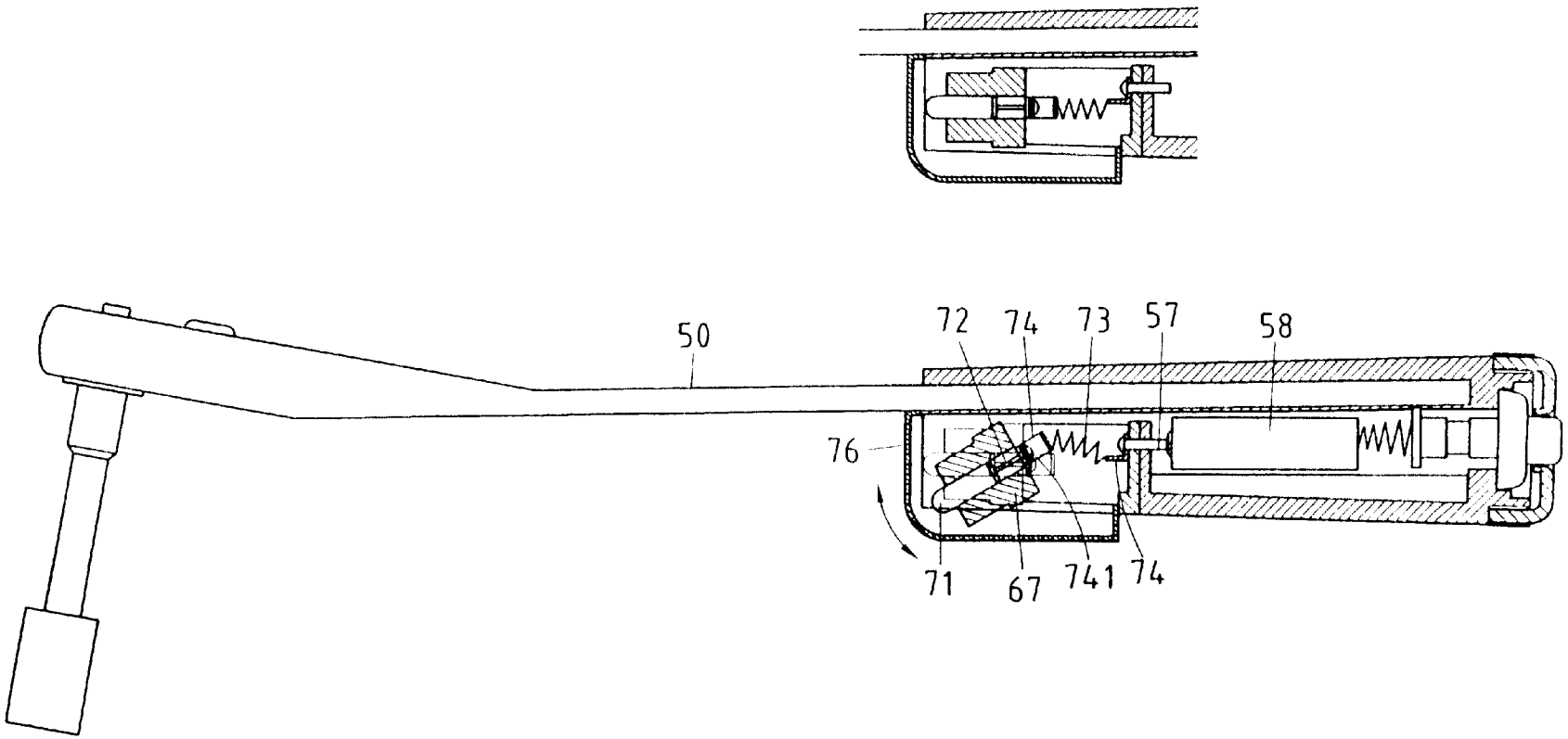
FIG. 8 shows a schematic view of the present invention in action.

The light-emitting elements 71 are disposed in the through holes 69 of the rotary body 67 such that the pins 72 of the light-emitting elements 71 are securely connected with the terminals 74 of the elastic bonding wires 73 by the screws 741. As a result, the elastic bonding wires 73 are always connected securely with the battery sets 58, at such time when the dial buttons 75 are turned to adjust the lighting angle of the light-emitting elements 71 as shown in FIG. 8. The light-emitting elements 71 of the present invention are protected by the a transparent cover 76, which is fastened to the bottom of the base 65.

I claim:

1. A socket wrench lighting apparatus comprising:

a handle;

a grip body having a fitting hole in one end thereof, said handle having an end fitted into said fitting hole, said grip body having a plugging hole at an opposite end thereof, said plugging hole having a threaded portion extending outwardly from a shoulder formed thereon, said plugging hole receiving two parallel batteries with a switching element electrically connected thereto, said switching element having a press button extending outwardly of a protruded shoulder formed on said switching element, said switching element having a connection point spring cooperative with each of said two parallel batteries, said plugging hole having a cap threadedly received on said threaded portion and residing against said shoulder of said plugging hole, said cap having a receiving hole; and a base affixed to an underside of said grip body at said one end of said grip body, said base having two pivoting slots, said base comprising:

a rotary body having two rotary shafts respectively received in said two pivoting slots, each of said two rotary shafts having a dial button affixed thereto, said rotary body having a pair of through holes;

two light-emitting elements respectively received in said two through holes of said rotary body, each of said two light-emitting elements having a pin extending outwardly of said rotary body;

two elastic bonding wires disposed between said rotary body and said batteries, said two elastic bonding wires having respectively two terminals connected respectively to said batteries by a plurality of conductive screws, said two elastic bonding wires having respectively another two terminals respectively connected to the pins of said two light-emitting elements by a plurality of screws; and a transparent cover fastened to a bottom of said base, said transparent cover shielding said two light-emitting elements.

* * * * *